US007880582B2

(12) United States Patent
Tepper et al.

(10) Patent No.: US 7,880,582 B2
(45) Date of Patent: Feb. 1, 2011

(54) LAYERED ELECTRICALLY CONDUCTIVE MATERIAL

(75) Inventors: Jens Tepper, Brillon (DE); Friedrich Koenig, Oberboezberg (CH); Kaveh Niayesh, Tehran (IR); Stephan Schoft, Geneva (CH)

(73) Assignee: ABB Research Ltd, Zurich (CH)

( * ) Notice: Subject to any disclaimer, the term of this patent is extended or adjusted under 35 U.S.C. 154(b) by 105 days.

(21) Appl. No.: 12/419,419

(22) Filed: Apr. 7, 2009

(65) Prior Publication Data

US 2009/0206979 A1 Aug. 20, 2009

Related U.S. Application Data

(63) Continuation of application No. PCT/CH2006/000568, filed on Oct. 12, 2006.

(51) Int. Cl.
*H01C 10/10* (2006.01)

(52) U.S. Cl. ..... 338/115

(58) Field of Classification Search ..... 338/115, 338/22 R, 224, 319, 320, 330–331; 29/610.1
See application file for complete search history.

(56) References Cited

U.S. PATENT DOCUMENTS 1,956,859 A 5/1934 Everett
3,227,983 A 1/1966 Braun
5,414,403 A 5/1995 Greuter et al.
6,021,564 A * 2/2000 Hanson ..... 29/852
7,192,654 B2 * 3/2007 Andresakis et al. ..... 428/626

FOREIGN PATENT DOCUMENTS

EP 0 576 836 A2 1/1994
FR 940.438 A 12/1948

OTHER PUBLICATIONS

Form PCT/ISA/210 (International Search Report) dated Jun. 11, 2007.
Form PCT/ISA/237 (Written Opinion of the International Searching Authority) dated Jun. 11, 2007.
Form PCT/IPEA/409 (International Preliminary Report on Patentability) dated Oct. 28, 2008.

* cited by examiner

*Primary Examiner*—Kyung Lee
(74) *Attorney, Agent, or Firm*—Buchanan Ingersoll & Rooney PC

(57) ABSTRACT

An electrical resistor has an electrically conductive stack, which includes a plurality of metal first layers and second layers. The stack allows to produce a highly anisotropic resistor, in which the resistance in the direction perpendicular to the layers is much higher than in the plane of the layers. The anisotropy allows the current flowing through the stack to be made homogenous, e.g., to be distributed over the entire stack surface, even if the current is input into the stack in an inhomogenous manner.

51 Claims, 1 Drawing Sheet

LAYERED ELECTRICALLY CONDUCTIVE MATERIAL

RELATED APPLICATION

This application claims priority as a continuation application under 35 U.S.C. §120 to PCT/EP2006/000568 filed as an International Application on Oct. 12, 2006 designating the U.S., the entire content of which is hereby incorporated by reference in its entirety

TECHNICAL FIELD

The present disclosure belongs to the field of electrically conducting materials and generally relates to an electrical resistor. More specifically, it relates to an electrical resistor having an electrically conductive stack, which comprises, in particular, a plurality of metal layers.

BACKGROUND INFORMATION

Many power and automation technology applications require resistive materials whose resistance or specific resistivity can be adjusted. Depending on the application, a resistive material should carry e.g. nominal and fault currents up to at least a few tens of kA and more, and support voltages of more than 1 kV. Resistances ranging between a 1 mΩ and a few Ω, say 5Ω, may be required.

Graphite materials have a specific resistivity that can be adjusted by adding suitable materials. However, Graphite can overheat locally when inhomogeneous currents are applied, since its capacity for distributing the current homogeneously is poor. Thus, hot-spots are formed and the material deteriorates or may even disintegrate.

FR 940 438 discloses a layered electrical resistance with great power dissipation. The resistor is built from resistive elements that have metal-coated faces for contacting each other. In addition, wing-like cooling elements made from metal can be interposed in an alternating sequence with the resistive layers. A low contact resistance is achieved by arranging discs made of soft metal between the resistive elements and/or the cooling elements. Very high overall resistance values are achieved owing to the bulk resistance of the resistive elements.

U.S. Pat. No. 1,956,859 discloses a stacked electrical resistor with resistor blocks spaced apart by washers and connector strips and with the blocks being clamped or bolted together. Again, large resistances are obtained owing to the bulk resistances of the resistor blocks.

U.S. Pat. No. 3,227,983 relates to a stacked electrical resistor of similar type with certain improvements, such as resistor elements having different thickness, being made of carbon powder, being coated e.g with powdered copper, being held together by clamping means, or being bonded together via their confronting high conductivity coatings. The overall resistance is again determined by the sum of the bulk resistances of the resistor elements.

SUMMARY

Thus, a material is needed that is able to support high current loads, even when inhomogeneous current is applied, and that has a resistance that is adjustable over a wide range.

An the electrical resistor is disclosed and a method of manufacturing an electrical resistor is disclosed.

An electrical resistor is disclosed comprising an electrically conductive stack, the electrically conductive stack comprising a plurality of electrically conductive first layers and a plurality of electrically conductive second layers, wherein the total number of layers is three or more, the first layers are metal layers, and at least some of the first layers and second layers are arranged in an essentially alternating order, which is obtained from an alternating order by some further layer or layers possibly being inserted at arbitrary stack positions, characterized in that the contact resistance between two neighboring first and second layers is larger than the bulk resistance of one of the second layers.

A moveable electrical contact arrangement is disclosed, comprising an electrical resistor which comprises an electrically conductive stack, the electrically conductive stack comprising a plurality of electrically conductive first layers and a plurality of electrically conductive second layers, wherein the total number of layers is three or more, the first layers are metal layers, and at least some of the first layers and second layers are arranged in an essentially alternating order, which is obtained from an alternating order by some further layer or layers possibly being inserted at arbitrary stack positions, and the layers are arranged in substantially parallel planes, wherein the stack further has a contact surface substantially orthogonal to the planes of the layers and the contact arrangement further comprises a movable contacting element that can be moved over a portion of the contact surface.

In another aspect, a method of manufacturing an electrical resistor is disclosed based on an electrically conductive stack. Such a method comprises the following steps of: providing a plurality of electrically conductive first layers, which are metal layers; providing a plurality of electrically conductive second layers; choosing a total number of layers to be three or more; and arranging at least some of the first layers and the second layers in an essentially alternating order, which is obtained from an alternating order by some further layer or layers possibly being inserted at arbitrary stack positions, such as to form an electrically conductive stack of the electrical resistor, wherein the contact resistance between two neighboring first and second layers is larger than the bulk resistance of one of the second layers.

BRIEF DESCRIPTION OF THE DRAWINGS

The disclosure will be better understood by reference to the following description of exemplary embodiments of the disclosure taken in conjunction with the accompanying drawings, wherein.

DETAILED DESCRIPTION

According to an aspect of the disclosure, the electrical resistor comprises an electrically conductive stack, which has a plurality of electrically conductive metal first layers, and a plurality of electrically conductive second layers. The total number of layers is three or more. These layers are arranged in an essentially alternating sequence. This means that at least some of the layers are arranged in an alternating sequence, and that further layers may be inserted into the alternating sequence. The contact resistance between two neighboring first and second layers is larger than the bulk resistance of one of the second layers. The term "electrically conductive" generally refers to materials having a resistivity of typically less than approx. $10^{14}$ Ωm. Note that other layers, such as third, fourth etc. layers, may also be present in the stacked resistor according to the disclosure.

The presence of layers allows a variable design of the conductive resistor, which can thus be tailored to have desired properties. For example, electric properties and in particular the electrical resistance of the material can be adjusted or fine-tuned according to the desired application by choosing an appropriate thickness and/or material of the layers. Further, particularly due to the metal layers, a current transmitted through the stack may be made more homogenous.

According to a further aspect of the disclosure, a method of manufacturing an electrical resistor is provided. In the method, a plurality of electrically conductive first metal layers is provided; a plurality of electrically conductive second layers is provided; the total number of layers is three or more; and the first layers and the second layers are arranged in an essentially alternating sequence, wherein the contact resistance between two neighboring first and second layers is larger than the bulk resistance of one of the second layers, such as to form an electrically conductive stack of the electrical resistor.

Figure 1:
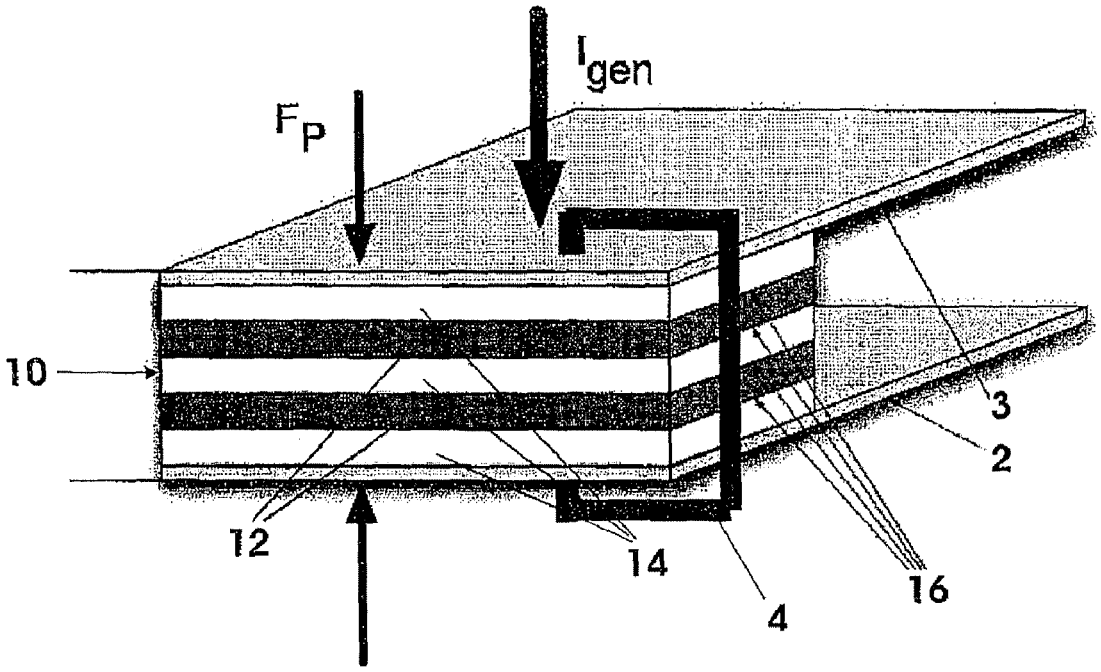
FIG. 1 is a schematic perspective view of an exemplary electrically conducting resistor according to the present disclosure.

FIG. 1 is a perspective view of an exemplary electrically conducting resistor 1 according to the present disclosure. The electrical resistor 1 has a bottom plate 2 and a top plate 3. The resistor 1 further has an electrically conductive stack 10. The stack 10 comprises a plurality of electrically conductive metal layers 12, and a plurality of electrically conductive further layers 14.

In FIG. 1, the layers 12, 14 are arranged in the horizontal plane. The stack 10 allows to produce a highly anisotropic resistor, in which the resistance in the direction perpendicular to the layers 12, 14 is much higher than in the plane of the layers 12, 14.

The high resistance in the direction perpendicular to the layers 12, 14 can, in an example arrangement, be due to the high contact resistance between neighboring layers. The high contact resistance can be the result of a high constriction resistance, if the effective contacting surface, though which current can flow from one layer to the other, is small; an additional contribution may arise from resistance due to surface contaminations or surface coatings, such as oxide coatings (so called film resistance).

In order to produce a high constriction resistance, the layers 12, 14 can be provided as separate sheets that are mechanically pressed against each other by a pressing force $F_P$. It is advantageous that one of the sheets, e.g. the further sheet 14, is much softer than the other sheet, e.g. the metal sheet 12. Further, a relatively high pressing force $F_P$ may be applied. Then, the common mechanical surface, by which the sheets 12 and 14 are pressed against each other, is made large because the softer surface adapts to micro-bumps and -recesses of the harder surface. Consequently, mechanical stresses and heat can be distributed over a large area. Hence, even if a part of the surface is softened due to overheating, the effective contacting surface is essentially unchanged. In summary, the large mechanical surface can result in a long-time stable arrangement that supports large currents. In spite of the large mechanical surface, the effective contacting surface can be small, e.g. if portions of the mechanical surface are oxidized and therefore badly conducting.

The high contact resistance generally results in a highly anisotropic resistance of the stack 10. Namely, in a direction parallel to the layer planes, the layers are connected in parallel. Therefore the stack resistance is of the order of the smallest layer resistance (e.g. of the resistance of the metal layer 12). In contrast, in the direction orthogonal to the layer plane, the layers are connected in series. Therefore, the stack resistance is roughly of the order of the contact resistance between neighboring layers. Thereby, for example, a resistance ratio between a maximum-resistance direction and a minimum-resistance direction can be achieved that is larger than 2, or larger than 10, or even larger than 50.

In an alternative exemplary arrangement, the anisotropy of the resistor can be caused by the further layer 14 having a much higher resistance than the metal layer 12 and/or than the contact resistance between neighboring layers. In this case, the stack resistance in the direction orthogonal to the layer plane is roughly of the order of the highest layer resistance, i.e. of the resistance of the further layer 14.

Figure 2:
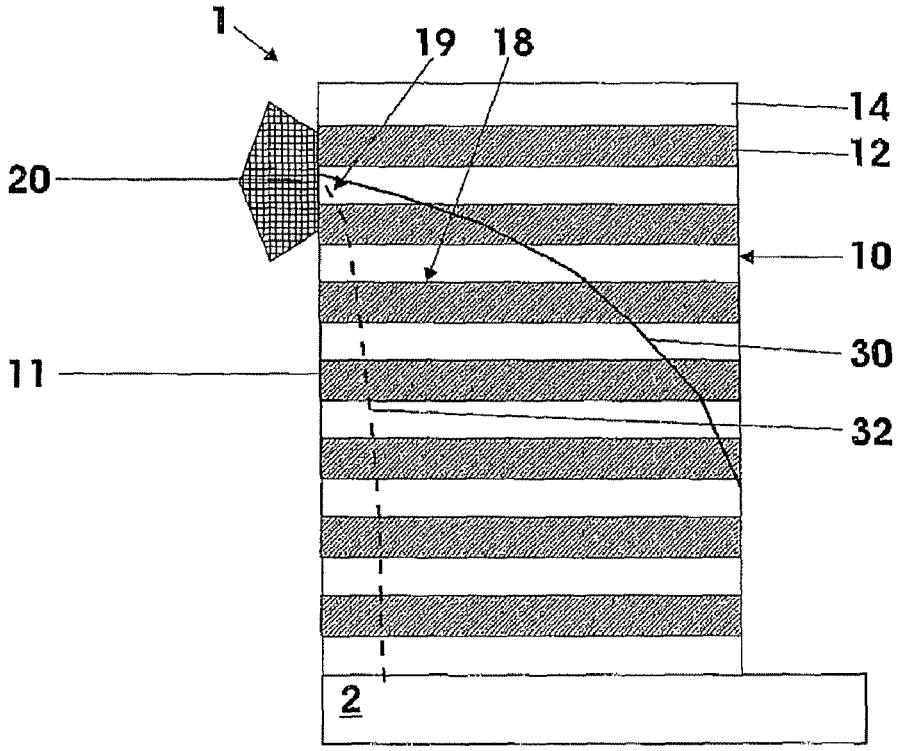
FIG. 2 is a schematic side view of an exemplary tunable resistance according to the present disclosure, which is connected to an electric circuit.

In either exemplary arrangement, the anisotropy allows the current to be made homogenous, i.e. distributed over the entire layer surface, even if it is input to the stack in an inhomogenous manner, as is shown in more detail in connection with FIG. 2.

In the following, the exemplary arrangement of the resistor of FIG. 1 is explained in more detail. The bottom plate 2 is made of a conductor (e.g. copper), and the top plate 3 is made of an insulator. However, independently of the shown exemplary embodiment each of the plates 2 and 3 can be made of any other solid conductive or insulating material. The plates 2, 3 have, each, a planar top surface and a planar bottom surface, and are arranged parallel to each other. More generally, the plates can have any shape, although it is preferred that the bottom plate 2 has at least an essentially planar top surface, and that the top plate 3 has at least an essentially planar bottom surface. The plates 2 and 3 can have mutually different shapes and dimensions. The bottom plate 2, the top plate 3, or both plates can also be omitted.

The metal layers 12 can be made of aluminium, copper, steel, silver, tin or of any other metal. A metal is defined as a material having metal elements. Here, metal elements do not include metalloids. According to this definition, e.g. so-called metal polymers and organic metals are not considered to be metals.

The further layers 14 are made of an electrically conductive material. The further layers 14 preferably have a higher resistance than the metal layers 12. Independently of the shown exemplary embodiments, the further layers 14 can be made of a metal, a non-metal, a material that is substantially more resistive, or substantially less resistive, than the metal layer material, or a material that is substantially softer, or substantially harder, than the metal layer material.

For example, and independently of the shown exemplary embodiments, the further layers 14 can be made of a material that differs, in Vickers hardness, from the metal layer material by less than 20% of the Vickers hardness of the metal layers 12. Further, the material of the further layers 14 can have a Vickers hardness that is different from the Vickers hardness of the metal layers 12, preferably by more than 20% of the Vickers hardness of the metal layers 12. Preferably, the further layer 14 has a lower Vickers hardness than the metal layers 12.

The further layers 14 may include an electrically conductive material selected from the group consisting of carbons, such as graphite; metals, preferably soft metals, such as lead and aluminium; conductive plastics, such as carbon fiber reinforced plastic; conductive epoxy; and/or of electrically conductive ceramics, such as Boron carbide and Tungsten carbide; metals including metal alloys, such as steel, titanium alloys or nickel alloys; sintered materials, in particular sintered metals; constantan or constantan alloys; metal oxides, such as titanium oxide, vanadium oxide or barium titanate; conductive plastics, such as carbon fiber reinforced plastic; cermet; and doped silicones. A ceramic is generally an inorganic non-metal formed under heat.

The layers 12, 14 can all be made of the same material or of different materials. The metal layers 12 and/or the further layers 14 can be coated, e.g. by using a metal coating.

Independently of the shown exemplary embodiment, the metal layers 12 and/or the further layers 14 can have each a thickness that is preferably less than 5 mm or 2 mm or even 1 mm, and/or that is preferably more than 0.01 mm, 0.05 mm, or even 0.1 mm.

The layers 12 and 14 are arranged in an essentially alternating sequence on top of each other such as to form the stack 10. For example, the layers 12, 14 of FIG. 1 are arranged in an alternating order. More generally, the layers could also be arranged in an essentially alternating order, e.g. in the order 14-12-14-14-12 or 14-12-14-(some other layer)-12. An essentially alternating order is obtained from an alternating order, with some further layer or layers possibly being inserted at arbitrary stack positions.

In the stack 10 shown in FIG. 1, there are two metal layers 12 and three further layers 14. Independently of the shown exemplary embodiment, the total number of layers may be 3 or more. An alternating sequence of 3 layers is 12-14-12 and 14-12-14. Preferably, in the stack 10 the total number of layers is larger than 5, larger than 10 layers, larger than 20 layers or larger than 40 layers, and/or the total number of layers is smaller than 1000 layers or smaller than 100 layers.

Each of the layers 12, 14 defines a plane. The planes are substantially parallel to each other. The layers 12, 14 all have the same shape and are arranged on top of each other. However, the layers 12, 14 could also have different shapes, and they could be arranged such that at least some of the neighboring planes overlap only partially. Further, all layers have substantially the same thickness. However, the layers could as well have mutually different thickness, and they could not be parallel.

The electrical resistor 1 can be adapted to have desired electrical properties, which are in the following described in more detail. The resistor 1 has in general a total resistance of more than 1 mΩ in at least one direction, preferably including the direction perpendicular to the layer planes. Generally, the resistance of the stack 10 can be made highly anisotropic (see above). This anisotropy allows to homogenize the current density (see FIG. 2).

Preferably, the bulk resistance of a metal layer 12 is lower than the bulk resistance of a further layer 14. In particular, the bulk resistance of one metal layer 12 can be less than 50%, or less than 20% or even less than 10% of the bulk resistance of one further layer 14. Alternatively, the bulk resistance of one metal layer 12 may be more than 100%, preferably more than 140% or even more than 200% of the bulk resistance of one further layer 14.

Preferably, the further layers 14 each have a bulk resistivity of more than $10^{-8}$ Ωm, more preferred of more than $10^{-6}$ Ωm or even more than $10^{-5}$ Ωm. Further, they preferably have a bulk resistivity of less than 1 Ωm, more preferred of less than $10^{-2}$ Ωm.

In some exemplary embodiments, the contact resistance between neighboring layers can be larger than the bulk resistance of the metal layer 12, preferably by a factor of more than 2 or even more than 10. Alternatively, the contact resistance may be less than 20% of the bulk resistance of any further layer 14.

Preferably, the contact resistance between neighboring layers 12, 14 is more than $10^{-5}$Ω or even more than $10^{-4}$Ω; it is preferably less than $10^{-2}$Ω or even less than $10^{-3}$Ω.

The layered structure of stack 10 allows adjusting the electrical resistance according to the desired application. This can be done by choosing an appropriate material of the layers 12, 14, and, in particular, of the further layer 14.

For example, if the metal layers 12 are metal sheets and the further layers 14 are graphite sheets, the resistance in the vertical direction is usually dominated by the contact resistance between neighboring graphite sheets 14 and metal sheets 12. While details depend on the nature of the surface of the graphite and the metal sheet, this contact resistance is preferably in the range of 100 to 500 μΩ, assuming a stack cross section of approx. 10 $cm^2$. The total resistance for a given height can be tailored by choosing an appropriate average thickness of the sheets 12 and 14. For example, the thickness of both sheets may individually be varied between 0.1 mm and a few mm, say 3 mm. Then, assuming the above stack cross section of approx. 10 $cm^2$, a resistance of approx. 0.0003 to 0.05Ω per cm stack thickness (vertical height) can be achieved.

As a further example, if the further layers 14 are ceramic layers, the resistance in the vertical direction is usually dominated by the bulk resistance of these layers 14. In this case, the total resistance for a given height can be tailored by choosing an appropriate average ratio of the ceramic layer thickness over the metal layer thickness. For example, the thickness of the ceramic layers 14 may be between 0.1 and 1 times the thickness of the metal layers 12. Then, similar resistances as for the graphite case (see above) can be achieved.

The resistance can be adapted by varying other material parameters as well. For example, the stack cross section (area of the layers) can be varied. Further, the hardness of the surface of the metal layer 12 can be varied, e.g. by tempering or coating the metal, e.g. by using silver, nickel, or chromium. A coating by a metal of relatively low hardness, e.g. silver, can reduce the contact resistance between neighboring layers. Further, the coating can protect against oxidation, diffusion and corrosion, and can thus further increase the long-time stability of the contact resistance. Independently of the shown exemplary embodiment, the metal layers can be coated using a metal coating. The coating may include a metal that is different from the metal of the metal layers. The coating may comprise e.g. silver, nickel, or chrome.

The stack 10 shown in FIG. 1 can be assembled in the following way: separate metal sheets and further sheets are placed on top of each other in alternating order such as to form the layers 12, 14. The sheets are then mechanically pressed against each other by a pressing force $F_P$. The electrical contact resistance generally decreases as the pressing force $F_P$ grows, because the constriction resistance is reduced. For high pressing forces $F_P$, the contact resistance between neighboring layers of the stack 10 saturates, i.e. depends only weakly on further small variations of the pressing force $F_P$. Independently of the shown exemplary embodiment, it is preferred that the applied pressing force $F_P$ is sufficiently high that the contact resistance between neighboring layers of the stack 10 essentially saturates, because then the conductor properties of the stack are generally long-time stable. For example, the pressing force $F_P$ can be chosen between 10 N per $mm^2$ and 100 N per $mm^2$.

It is advantageous to sandwich the stack 10 between the bottom plate 2 and the top plate 3, as is shown in FIG. 1. A pressing force $F_P$ that presses the plates 2, 3 together can then be applied continually. For example the plates 2 and 3 can be connected by one or more screws, which are tightened in order to apply the desired pressing force. Instead of screws, any clamping units 4, as schematically shown in FIG. 1, can be used. The clamping units 4 can extend through holes in the stack 10 or through an outside region of the stack 10. If electrically conducting screws or other clamping units 4 are used, it is preferred that they are not in direct electrical contact with the stack 10. Thus, it can be avoided to short-circuit the stack 10. Pressing the layers 12, 14 may also result in self-adhesion or bonding together of the stack 10 such that external clamping units 4 are not needed.

There are alternative methods for assembling the stack 10, For example, each layer can be formed on top of another layer using a deposition technique, e.g. vapour deposition or a galvanisation method. The application of the metal layers 12 may require a different deposition technique than the application of the further layers 14, in which case the stack may have to be transferred between different chambers. Alternatively, sheets comprising pairs of layers can be produced, e.g. by coating a sheet with a coating, such that the sheet and/or the coating is formed as a metal layer. Then, the coated sheets can be arranged on top of each other, in order to produce the stack, and be mechanically pressed against each other, as discussed above. Optionally, during production of the stack, the stack may be heated in order to create a permanent contact between neighboring sheets. This may result in a sort of sintering the stack together. During this heating, the stack may optionally be pressed together.

In FIG. 2, a possible application of the electrically conducting resistor 1 in an exemplary tunable resistance is shown. The tunable resistance has two electrodes. The first electrode is formed by the electrical resistor 1 with horizontal layers 12, 14 as described in the context of FIG. 1. The first electrode 1 further has a vertical contact surface 11. More precisely, the layers 12, 14 are arranged in substantially parallel planes, and the contact surface 11 is substantially orthogonal to the planes of the layers 12 and 14. Preferably, this surface is polished or made planar in some other way. The Electrical resistor 1 is further contacted to an external lead and thereby to an electrical supply, e.g. a voltage supply, via the bottom plate 2. The bottom plate is in direct electrical contact with one of the metal layers.

The second electrode 20 is a contact that is moveable over a portion of the contact surface 11 in a direction perpendicular to the layers of the stack 10, and that is in electrical contact with the contact surface 11. If the second electrode 20 is moved away from the bottom plate 2, the current has to travel a relatively long way through the stack 10, resulting in a high resistance. If the second electrode 20 is moved towards the bottom plate 2, the current has a relatively short way through the stack 10, resulting in a low resistance. Thus, a tunable resistance 1 is provided.

Alternatively, a tap-changer (not shown) can be provided. The tap changer has a finite number of fixed contacts to the stack 10 at various distances from the bottom plate 2, and a switching arrangement that can variably select one or more of the fixed contacts to be contacted to the external lead. The fixed contacts could be, for example, formed by some of the metal layers that extend outwardly from the stack 10.

It is preferred that the size of the moveable second electrode 20 is equal to or larger than a layer thickness of a graphite layer 14. For this purpose, the contact surface of the second electrode 20 can be made sufficiently large such that it contacts more than one layer 12, 14, or at least one metal layer 12 regardless of the position of the contacting element at the contact surface 11 of the stack 10.

Preferably, the second electrode 20, i.e. the moveable contacting element 20, contacts at least one metal layer 12 and at least one graphite layer 14 regardless of its position at the contact surface 11 of the stack 10. The electrical conductivity at the contact of the stack 10 with the moveable contacting element 20 is usually dominated by the contact between the metal layer 12 and the moveable contacting element 20.

FIG. 2 further illustrates how the metal layers 12 homogenize the current. During operation, the current is transmitted from the base plate 2 through the stack 10 to the moveable contacting element 20, which could be implemented by a liquid metal drop. The solid line 30 schematically delimits the region 18 of the stack 10 in which the current is high (region 18 lies below and left of the line 30) from the region in which the current is low (region above and right of the line 30). Here, high/low currents refer to currents that are higher/lower than a suitably chosen limiting current. It is seen from FIG. 2 that in the layers 12, 14 that are near the moveable contacting element 20, or liquid metal drop respectively, the entire current is concentrated in the small region 19 close to moveable contacting element 20, or liquid metal drop respectively. In this region 19, the current density is particularly high. In the layers that are at a greater vertical distance below the moveable contacting element 20, or liquid metal drop respectively (remainder of region 18), however, the current is homogenized and distributed more evenly.

This homogenization is possible, because the resistance of the sheet is anisotropic. This anisotropy results from the relatively high conductivity of the metal layers 12. If the metal layers 12 were absent, i.e. in a resistor having only graphite layers, the homogenization would be far less efficient. The dashed line 32 illustrates schematically how the region of high current, delimited by line 30 in the presence of the metal layers 12, would be modified, if the metal layers 12 were absent. In this case, the graphite layers only could not homogenize the current sufficiently. Thus, even in the layers at a relatively large vertical distance from the moveable contacting element 20, or liquid metal second electrode respectively, the region of high currents would remain small. In other words, the current would be concentrated in a small portion of the resistor. As the current in graphite concentrates in hot spots, even already at moderately high current densities, the graphite would disintegrate at least in the vicinity of the hot-spots and/or of the moveable contacting element 20. Thus, the tolerable current density would be low. In contrast, in the presence of the metal layers 12 the current is homogenized more efficiently, and the maximum allowable current is increased. Thus, in some exemplary embodiments, currents of up to 10 to 100 kA can be supported by the resistor 1. For the above-described sizes and materials, up to 100 to 1000 kJ of energy can be dissipated.

Likewise, the maximum allowable voltage between two neighboring layers, i.e. over a contact resistance, can be increased by using suitable materials for the layers 12 and 14. For contacts between metal sheets of similar hardness, this voltage, also known as maximum contact voltage, is preferably around 0.1 V. If the maximum contact voltage is exceeded, the material heats up and softens or melts at the contact spots. As a consequence, the contact resistance decreases and is not long-time stable. By using a graphite layer or a soft material layer as the further layer 14, the maximum contact voltage between two neighboring layers 14, 12 can be designed to increase to 0.5 V and more, and the contact resistance remains long-time stable under such voltage loads.

The electrically conducting resistor 1 can be used for other purposes than the ones mentioned above. For example, it can be used as a non-tunable resistor or, e.g., as a pressure sensor. Further, any range of values given herein may be extended or modified without losing the principal effects achieved by the disclosure, as will be apparent to the skilled person.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Resistor
2 Electric contact/Base plate/Lead
3 Top plate
10 Stack
11 Vertical Contact surface
12 Metal layer
14 Further layer
16 Contact planes between layers
18 High-current region
19 Region of particularly high current near contacting element
20 Second Electrode/moveable contacting element

What is claimed is:

1. An electrical resistor comprising an electrically conductive stack, the electrically conductive stack comprising a plurality of electrically conductive first layers and a plurality of electrically conductive second layers, wherein the total number of layers is three or more, the first layers are metal layers, and at least some of the first layers and second layers are arranged in an essentially alternating order, which is obtained from an alternating order by some further layer or layers possibly being inserted at arbitrary stack positions, wherein the contact resistance between two neighboring first and second layers is larger than the bulk resistance of one of the second layers.

2. The electrical resistor according to claim 1, wherein the second layers are non-metal layers.

3. The electrical resistor according to claim 1, wherein the first layers have a higher Vickers hardness than the second layers, preferably by more than 20% of the Vickers hardness of the first layers.

4. The electrical resistor according to claim 1, wherein the bulk resistance of the second layers is higher than the bulk resistance of the first layers.

5. The electrical resistor according to claim 1, wherein the second layers have a resistivity of more than $10^{-8}$ Ωm and less than 1 Ωm.

6. The electrical resistor according to claim 1, wherein the effective contacting surface, through which current can flow form one layer to the other, is small and the contact resistance results from a high constriction resistance.

7. The electrical resistor according to claim 1, wherein an additional contribution to the contact resistance arises from resistance due to surface contaminations or surface coatings, in particular from film resistance or oxide coatings.

8. The electrical resistor according to claim 1, wherein a large mechanical surface results in long-time stable arrangement that supports large currents, and the effective contacting surface is small, in particular wherein portions of the mechanical surface are oxidized and therefore badly conducting.

9. The electrical resistor according to claim 1, wherein the contact resistance between neighboring layers is more than $10^{-5}$Ω.

10. The electrical resistor according to claim 1, wherein the contact resistance between neighboring layers is less than $10^{-2}$Ω.

11. The electrical resistor according to claim 1, wherein an average resistance per layer in a direction perpendicular to a plane of the layers is more than 5 μΩ, in particular that an average resistance per second layer in a direction perpendicular to a plane of the layers is more than 5 μΩ.

12. The electrical resistor according to claim 1, wherein an average resistance per layer in a direction perpendicular to a plane of the layers is less than 5 mΩ, in particular that an average resistance per second layer in a direction perpendicular to a plane of the layers is less than 5 mΩ.

13. The electrical resistor according to claim 1, wherein the second layers include an electrically conductive material selected from the group consisting of carbons, such as graphite; soft metals, such as lead and aluminium; conductive plastics, such as carbon fiber reinforced plastic; conductive epoxy; and/or of electrically conductive ceramics, such as Boron carbide and Tungsten carbide; metals including metal alloys, such as steel, titanium alloys or nickel alloys; sintered materials, in particular sintered metals; constantan or constantan alloys; metal oxides, such as titanium oxide, vanadium oxide and barium titanate; cermet; and doped silicones.

14. The electrical resistor according to claim 1, wherein the first layers and/or the second layers are coated with a metal coating.

15. The electrical resistor according to claim 1, wherein the plurality of layers are more than 4 layers and preferably more than 10 layers.

16. The electrical resistor according to claim 1, wherein the layers are sheets, which are stacked together by mechanically pressing them against each other and, in particular, are held in pressed state by means of clamping units.

17. The electrical resistor according to claim 1, wherein the layers are arranged in substantially parallel planes, and wherein the stack further has a contact surface substantially orthogonal to the planes of the layers.

18. A moveable electrical contact arrangement, comprising an electrical resistor which comprises an electrically conductive stack, the electrically conductive stack comprising a plurality of electrically conductive first layers and a plurality of electrically conductive second layers, wherein the total number of layers is three or more, the first layers are metal layers, and at least some of the first layers and second layers are arranged in an essentially alternating order, which is obtained from an alternating order by some further layer or layers possibly being inserted at arbitrary stack positions, and the layers are arranged in substantially parallel planes, wherein the stack further has a contact surface substantially orthogonal to the planes of the layers and the contact arrangement further comprises a movable contacting element that can be moved over a portion of the contact surface.

19. The moveable electrical contact arrangement as claimed in claim 18, wherein the contact surface of the movable contacting element is sufficiently large such that it contacts more than one layer or at least one metal layer regardless of the position of the contacting element at the contact surface of the stack.

20. The moveable electrical contact arrangement as claimed in claim 18, wherein the movable contacting element is a liquid metal drop.

21. The moveable electrical contact arrangement as claimed in claim 18, wherein in the layers that are at a greater vertical distance below the movable contacting element, the current is homogenized and distributed more evenly, because the resistance of the sheet is anisotropic, which results from the relatively high conductivity of the metal layers.

22. The moveable electrical contact arrangement as claimed in claim 18, wherein currents of up to 10 kA to 100 kA can be supported by the resistor.

23. The moveable electrical contact arrangement as claimed in claim 18, wherein 100 kJ to 1000 kJ of energy can be dissipated.

24. The moveable electrical contact arrangement as claimed in claim 18, wherein by using a graphite layer or a soft material layer as the second layer, the maximum contact voltage between two neighboring layers can be designed to increase to 0.5 V and more, and the contact resistance remains long-time stable under such voltage loads.

25. The moveable electrical contact arrangement as claimed in claim 18, wherein the contact resistance between two neighboring first and second layers is larger than the bulk resistance of one of the first layers and/or second layers.

26. A method of manufacturing the electrical resistor as claimed in claim 1, the method comprising the following steps of:

providing a plurality of electrically conductive first layers, which are metal layers;

providing a plurality of electrically conductive second layers;

choosing a total number of layers to be three or more; and arranging at least some of the first layers and the second layers in an essentially alternating order, which is obtained from an alternating order by some further layer or layers possibly being inserted at arbitrary stack positions, such as to form an electrically conductive stack of the electrical resistor, wherein the contact resistance between two neighboring first and second layers is larger than the bulk resistance of one of the second layers.

27. The method as claimed in claim 25, wherein the bulk resistance of the second layers is chosen higher than the bulk resistance of the first layers.

28. The method as claimed in claim 25, wherein the layers are sheets, further comprising the step of mechanically pressing the sheets against each other.

29. The electrical resistor according to claim 2, wherein the first layers have a higher Vickers hardness than the second layers, preferably by more than 20% of the Vickers hardness of the first layers.

30. The electrical resistor according to claim 3, wherein the bulk resistance of the second layers is higher than the bulk resistance of the first layers.

31. The electrical resistor according to claim 4, wherein the second layers have a resistivity of more than $10^{-8}$ Ωm and less than 1 Ωm.

32. The electrical resistor according to claim 5, wherein the effective contacting surface, through which current can flow form one layer to the other, is small and the contact resistance results from a high constriction resistance.

33. The electrical resistor according to claim 6, wherein an additional contribution to the contact resistance arises from resistance due to surface contaminations or surface coatings, in particular from film resistance or oxide coatings.

34. The electrical resistor according to claim 7, wherein a large mechanical surface results in long-time stable arrangement that supports large currents, and the effective contacting surface is small, in particular wherein portions of the mechanical surface are oxidized and therefore badly conducting.

35. The electrical resistor according to claim 8, wherein the contact resistance between neighboring layers is more than $10^{-5}$Ω.

36. The electrical resistor according to claim 9, wherein the contact resistance between neighboring layers is less than $10^{-2}$Ω.

37. The electrical resistor according to claim 10, wherein an average resistance per layer in a direction perpendicular to a plane of the layers is more than 5 μΩ, in particular that an average resistance per second layer in a direction perpendicular to a plane of the layers is more than 5 μΩ.

38. The electrical resistor according to claim 1, wherein an average resistance per layer in a direction perpendicular to a plane of the layers is less than 5 mΩ, in particular that an average resistance per second layer in a direction perpendicular to a plane of the layers is less than 5 mΩ.

39. The electrical resistor according to claim 12, wherein the second layers include an electrically conductive material selected from the group consisting of carbons, such as graphite; soft metals, such as lead and aluminium; conductive plastics, such as carbon fiber reinforced plastic; conductive epoxy; and/or of electrically conductive ceramics, such as Boron carbide and Tungsten carbide; metals including metal alloys, such as steel, titanium alloys or nickel alloys; sintered materials, in particular sintered metals; constantan or constantan alloys; metal oxides, such as titanium oxide, vanadium oxide and barium titanate; cermet; and doped silicones.

40. The electrical resistor according to claim 13, wherein the first layers and/or the second layers are coated with a metal coating.

41. The electrical resistor according to claim 14, wherein the plurality of layers are more than 4 layers and preferably more than 10 layers.

42. The electrical resistor according to claim 15, wherein the layers are sheets, which are stacked together by mechanically pressing them against each other and, in particular, are held in pressed state by means of clamping units.

43. The electrical resistor according to claim 16, wherein the layers are arranged in substantially parallel planes, and wherein the stack further has a contact surface substantially orthogonal to the planes of the layers.

44. The moveable electrical contact arrangement as claimed in claim 19, wherein the movable contacting element is a liquid metal drop.

45. The moveable electrical contact arrangement as claimed in claim 20, wherein in the layers that are at a greater vertical distance below the movable contacting element, the current is homogenized and distributed more evenly, because the resistance of the sheet is anisotropic, which results from the relatively high conductivity of the metal layers.

46. The moveable electrical contact arrangement as claimed in claim 21, wherein currents of up to 10 kA to 100 kA can be supported by the resistor.

47. The moveable electrical contact arrangement as claimed in claim 22, wherein 100 kJ to 1000 kJ of energy can be dissipated.

48. The moveable electrical contact arrangement as claimed in claim 23, wherein by using a graphite layer or a soft material layer as the second layer, the maximum contact voltage between two neighboring layers can be designed to increase to 0.5 V and more, and the contact resistance remains long-time stable under such voltage loads.

49. The moveable electrical contact arrangement as claimed in claim 24, wherein the contact resistance between two neighboring first and second layers is larger than the bulk resistance of one of the first layers and/or second layers.

50. A method of manufacturing an electrical resistor based on an electrically conductive stack, the method comprising the following steps of:

providing a plurality of electrically conductive first layers, which are metal layers;

providing a plurality of electrically conductive second layers;

choosing a total number of layers to be three or more; and arranging at least some of the first layers and the second layers in an essentially alternating order, which is obtained from an alternating order by some further layer or layers possibly being inserted at arbitrary stack positions, such as to form an electrically conductive stack of the electrical resistor, wherein the contact resistance between two neighboring first and second layers is larger than the bulk resistance of one of the second layers.

51. The method as claimed in claim 26, wherein the layers are sheets, further comprising the step of mechanically pressing the sheets against each other.

* * * * *